US006137213A

United States Patent [19]

Moyer et al.

[11] Patent Number: 6,137,213

[45] Date of Patent: Oct. 24, 2000

[54] FIELD EMISSION DEVICE HAVING A VACUUM BRIDGE FOCUSING STRUCTURE AND METHOD

[75] Inventors: Curtis D. Moyer, Phoenix; Peter A. Smith, Chandler; Robert H. Reuss, Fountain Hills; Troy A. Trottier, Mesa; Steven A. Voight, Gilbert; Diane A. Carrillo, Phoenix; Kevin J. Nordquist, Higley; Jaynal A. Molla, Gilbert; David W. Jacobs, Higley, all of Ariz.; Kathleen A. Tobin, San Antonio, Tex.

[73] Assignee: Motorola, Inc., Schaumburg, Ill.

[21] Appl. No.: 09/176,150

[22] Filed: Oct. 21, 1998

[51] Int. Cl.[7] ..... H01J 1/02

[52] U.S. Cl. ..... 313/309; 313/336; 313/495

[58] Field of Search ..... 313/309, 336, 313/351, 495

[56] References Cited

U.S. PATENT DOCUMENTS

| | | | |
|---|---|---|---|
| 3,890,177 | 6/1975 | Pfahnl et al. . | |
| 4,054,484 | 10/1977 | Lesh et al. . | |
| 4,289,846 | 9/1981 | Parks et al. . | |
| 4,857,481 | 8/1989 | Tam et al. . | |
| 5,259,799 | 11/1993 | Doan et al. | 445/24 |
| 5,508,584 | 4/1996 | Tsai et al. . | |
| 5,528,103 | 6/1996 | Spindt et al. . | |
| 5,541,473 | 7/1996 | Duboc, Jr. et al. | 313/422 |
| 5,543,691 | 8/1996 | Palevsky et al. . | |
| 5,604,394 | 2/1997 | Saito et al. | 313/422 |
| 5,649,847 | 7/1997 | Haven . | |
| 5,710,483 | 1/1998 | Peng . | |
| 5,877,594 | 2/1997 | Miyano et al. | 313/497 |

FOREIGN PATENT DOCUMENTS

| | | | |
|---|---|---|---|
| 2285168 | 12/1993 | United Kingdom . | |
| WO9839788 | 11/1998 | WIPO | H01J 1/88 |

OTHER PUBLICATIONS

Patent Abstracts of Japan, vol. 1995, No. 08, Sep. 29, 1995 (Sep. 29, 1995) & JP 07 130306 A (Futaba Corp), May 19, 1995 (May 19, 1995) abstract.

"Microbridge Plasma–Display Panel" by K.C. Choi, B. Hallock, R.A. Johnson, G. Dick; *SID 1998/IDigest*, pp. 357–360.

*Primary Examiner*—Vip Patel

*Attorney, Agent, or Firm*—S. Kevin Pickens; Kevin D. Wills

[57] ABSTRACT

A field emission device (100, 150) includes a cathode plate (102, 180) having electron emitters (116), an anode plate (104, 170) having a phosphor (107, 207, 307, 407) activated by electrons (119) emitted by electron emitters (116), and a vacuum bridge focusing structure (118, 158, 218, 318) for focusing electrons (119) emitted by electron emitters (116). Vacuum bridge focusing structure (118, 158, 218, 318) has landings (121, 122, 221, 322), which are attached to cathode plate (102, 180), and further has bridges (120, 220, 320), which extend above and beyond landings (121, 122, 221, 322, 421) to provide a self-supporting structure that is spaced apart from cathode plate (102, 180).

44 Claims, 9 Drawing Sheets

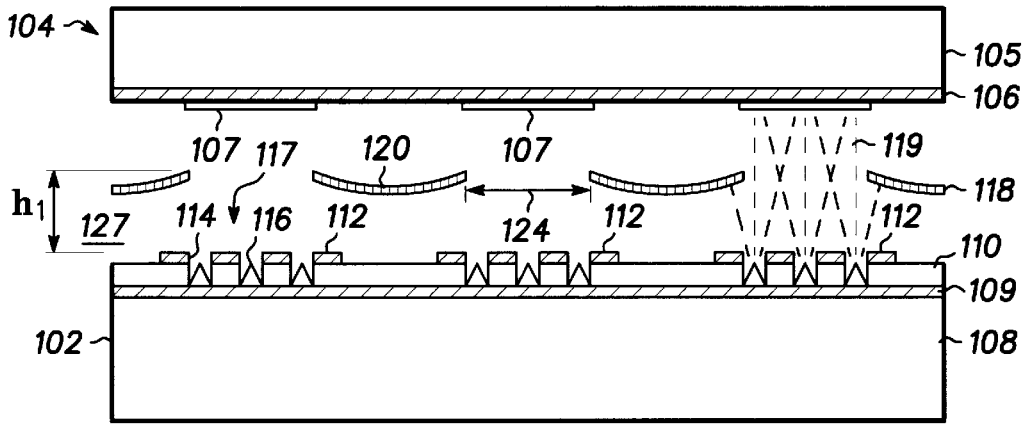
100 FIG. 2
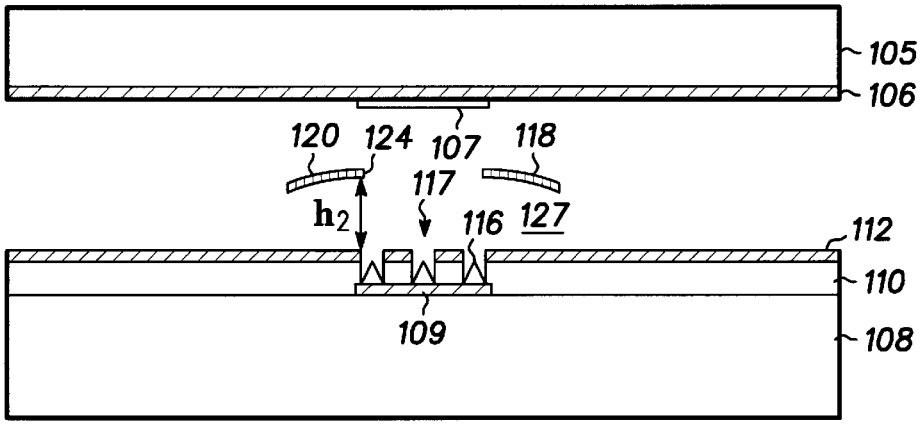
100 FIG. 3
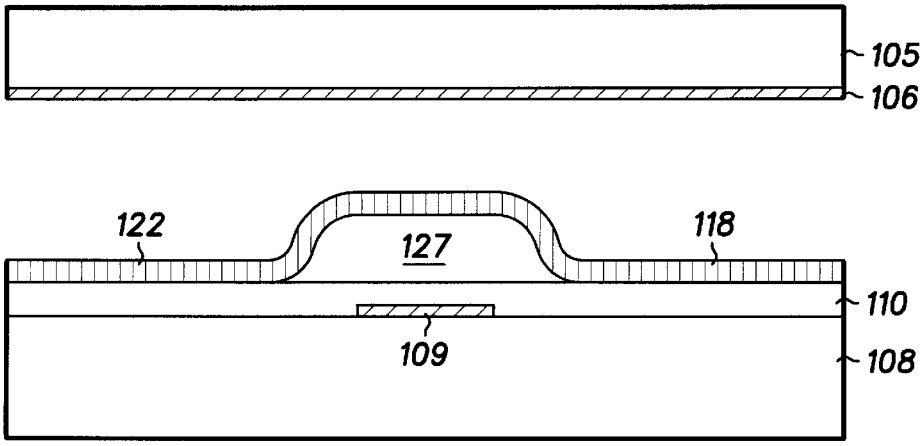
100 FIG. 4

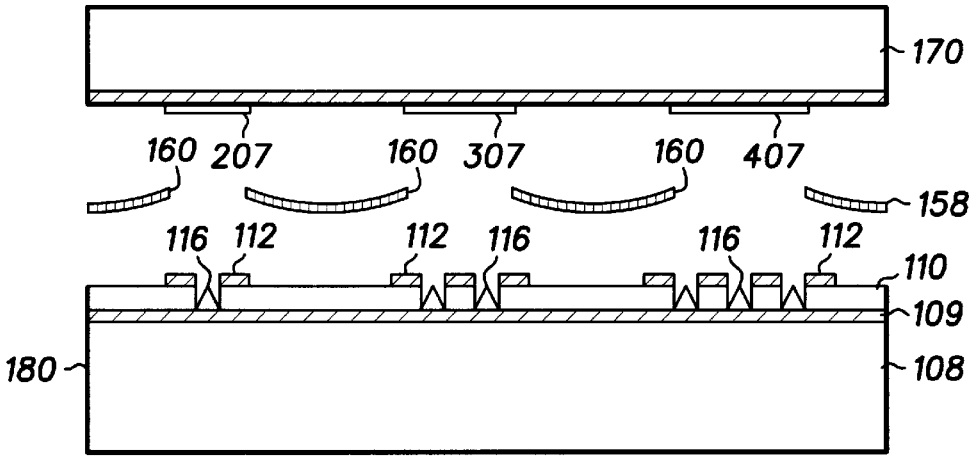
150 FIG. 5
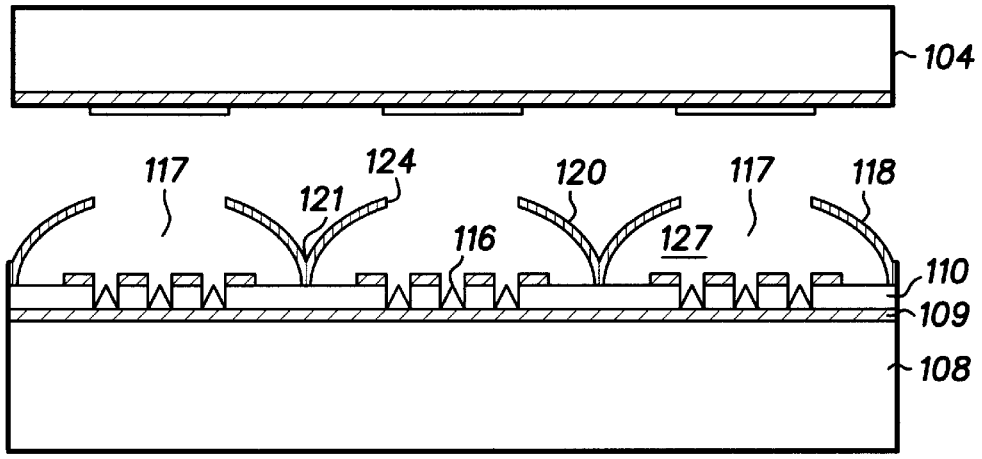
100 FIG. 6
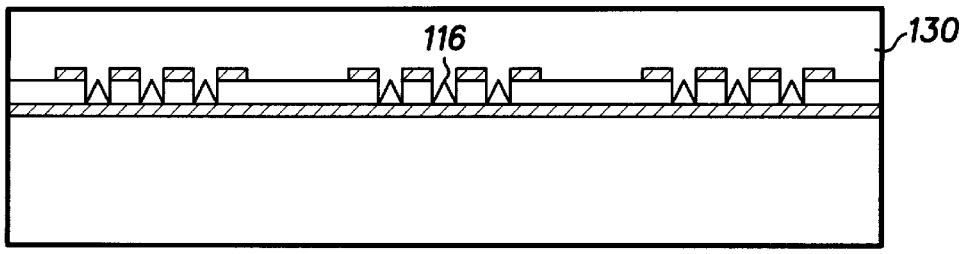
102 FIG. 10

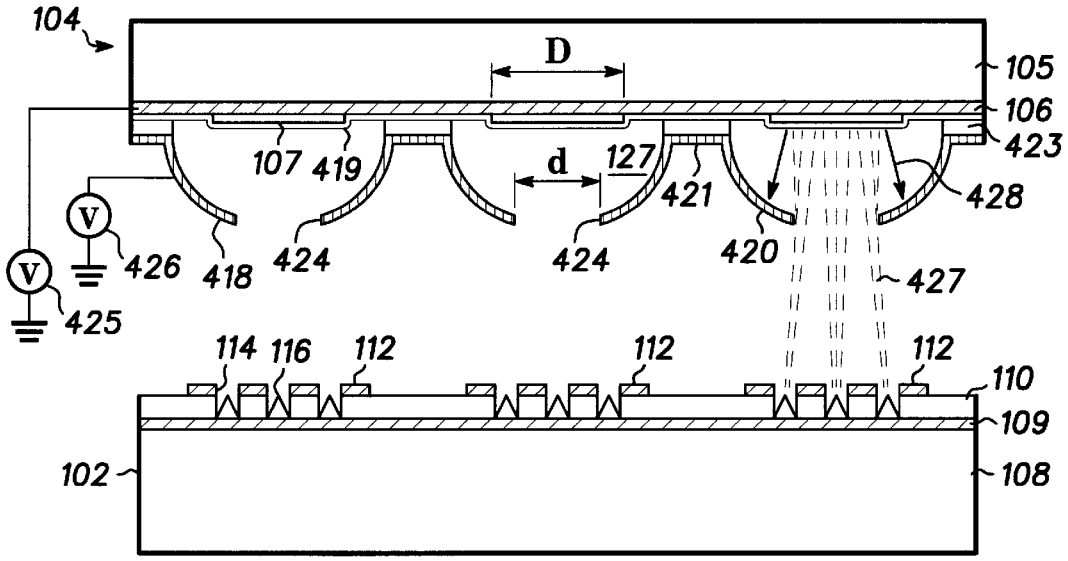
400 FIG. 17
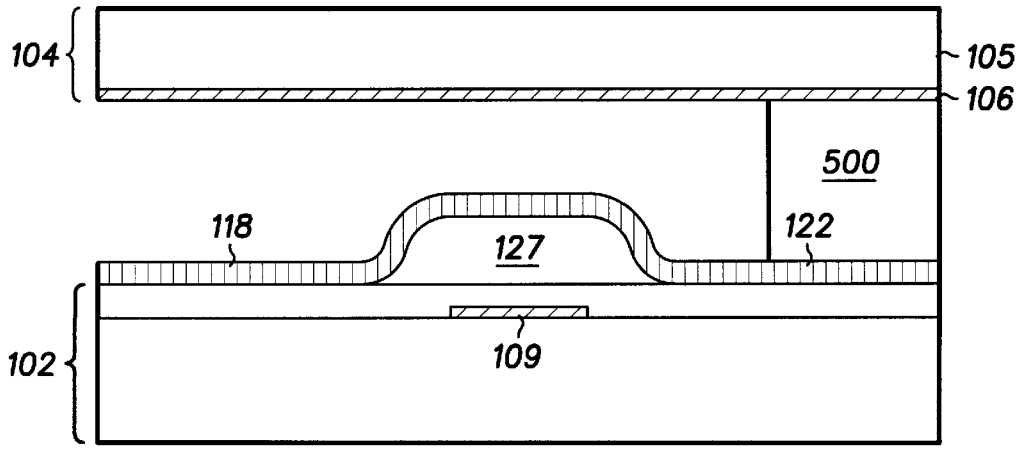
100 FIG. 24

FIELD EMISSION DEVICE HAVING A VACUUM BRIDGE FOCUSING STRUCTURE AND METHOD

FIELD OF THE INVENTION

The present invention relates, in general, to field emission devices, and, more particularly, to focusing structures for field emission devices.

BACKGROUND OF THE INVENTION

Field emission devices are well known in the art. Field emission devices generate electron beams from electron emitters at a cathode plate. Each of the electron beams is received at a "spot" on an anode plate and defines a corresponding "spot size." The separation distance between the cathode plate and the anode plate determine, in part, the spot size. It is known in the art to control the spot size by using focusing structures to collimate the electron beams.

High-voltage field emission devices operate at an anode voltage of greater than about 4000 volts relative to the cathode voltage. In these high-voltage devices, the separation distance between the cathode plate and the anode plate must be great enough to prevent unwanted electrical events, such as arcing between the cathode plate and the anode plate. The separation distance that is sufficient to prevent unwanted electrical events can result in an undesirably large spot size. Thus, focusing structures are frequently employed in high-voltage field emission devices.

However, prior art focusing structures often employ dielectric layers to support a focusing electrode and to separate the focusing electrode from the other electrodes, such as gate extraction electrodes, of the field emission device. Furthermore, these supporting dielectric layers determine the distance between the focusing electrode and the other device electrodes.

Such prior art focusing structures suffer from disadvantages. For example, the capacitance between the focusing structures and the gate extraction electrodes increases the power requirements of the device. Furthermore, the presence of the additional support layer increases the risk of generating gaseous contaminants. That is, contaminants can be evolved from the support layer. Generation of gaseous contaminants can occur during any high-temperature condition, such as typically encountered during the final sealing steps in the fabrication of the device.

Accordingly, there exists a need for a field emission device having a focusing structure, which improves operating power requirements and improves contaminant levels over the prior art, while allowing small "spot size" required for high-resolution displays.

BRIEF DESCRIPTION OF THE DRAWINGS

Referring to the drawings:

FIG. 2 is a cross-sectional view taken along the section lines 2—2 of FIG. 1;

FIG. 3 is a cross-sectional view taken along the section lines 3—3 of FIG. 1;

FIG. 4 is a cross-sectional view taken along the section lines 4—4 of FIG. 1;

FIG. 5 is a cross-sectional view similar to that of FIG. 2 of a field emission device having a vacuum bridge focusing structure, which defines a plurality of variable-size openings, in accordance with a further embodiment of the invention;

FIG. 6 is a cross-sectional view similar to that of FIG. 2 of a field emission device having a vacuum bridge focusing structure, which has a landing between adjacent pixels along a given cathode, in accordance with yet a further embodiment of the invention;

FIGS. 10–14 are cross-sectional views of a cathode plate at various stages in the fabrication of a vacuum bridge focusing structure in accordance with the invention;

FIG. 17 is a cross-sectional view of a field emission device having a vacuum bridge focusing structure attached to the anode plate in accordance with still yet another embodiment of the invention;

FIG. 24 is a cross-sectional view of a field emission device having a spacer supported on a landing of a vacuum bridge focusing structure in accordance with the preferred embodiment of the invention.

Figure 1:
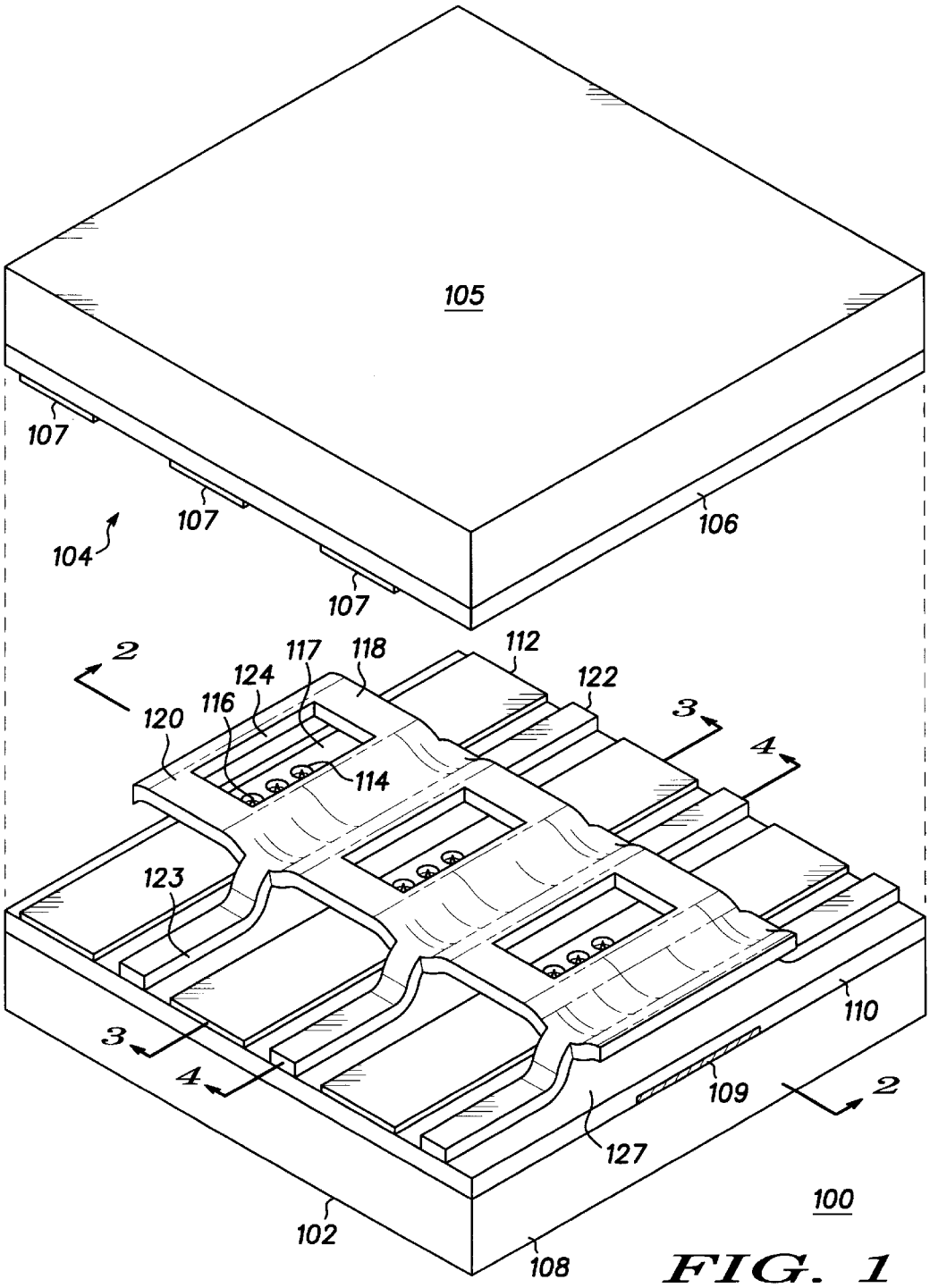
FIG. 1 is an exploded, perspective view of a field emission device in accordance with a preferred embodiment of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for a field emission device having a vacuum bridge focusing structure and for a method of fabricating the field emission device. The vacuum bridge focusing structure of the invention provides numerous advantages. For example, the vacuum bridge focusing structure of the invention is self-supporting. The self-supporting characteristic removes the necessity for additional support layers. The omission of additional support layers results in the advantage of reduced capacitance between the vacuum bridge focusing structure and other electrodes of the cathode plate. The reduced capacitance results in improved power requirements over the prior art. Furthermore, by removing the need for additional support layers, which can be made from organic or inorganic materials, the risk is reduced of introducing contaminants into the vacuum of the device.

FIG. 1 is an exploded, perspective view of a field emission device (FED) 100 in accordance with a preferred embodiment of the invention. FED 100 includes a cathode plate 102 and an anode plate 104, which opposes cathode plate 102.

Cathode plate 102 includes a substrate 108, which is preferably made from a transparent material, such as glass, quartz, and the like. Formed on substrate 108 are a plurality of cathodes 109. Cathodes 109 are columns of conductive material useful for addressing a plurality of electron emitters 116. Cathodes 109 can include ballast resistors (not shown) for controlling the distribution of electrical current over the device. A dielectric layer 110 is formed on cathodes 109, and a plurality of emitter wells 114 are formed within dielectric layer 110. One of electron emitters 116, which can include Spindt tips, is formed in each of emitter wells 114. A plurality of gate electrodes 112 are formed on dielectric layer 110 and circumscribe emitter wells 114. Gate electrodes 112 are also useful for selectively addressing electron emitters 116. Methods for forming cathode plates are known to one skilled in the art.

Anode plate 104 is disposed to receive electrons emitted by electron emitters 116. Anode plate 104 includes a transparent substrate 105, upon which is formed an anode 106. Transparent substrate 105 is preferably made from glass, and anode 106 is preferably made from indium tin oxide.

Anode plate 104 further includes a plurality of phosphors 107, which are formed on anode 106 and which define the pixels of anode plate 104. Each of phosphors 107 can emit light of the same wavelength, so that FED 100 is a monochromatic display. Alternatively, phosphors 107 can emit light of various colors, so that FED 100 is a polychromatic display. Methods for forming anode plates are known ton one skilled in the art.

In FIG. 1, electron emitters 116 define three pixels 117. When electrons are emitted by electron emitters 116 of a given pixel 117, the electrons are focused toward the one of phosphors 107 that corresponds to the given pixel 117.

In accordance with the invention, FED 100 further includes a vacuum bridge focusing structure 118, which provides the electron-focusing function. In the preferred embodiment of FIG. 1, vacuum bridge focusing structure 118 is a unitary structure that extends over and is attached to cathode plate 102. Vacuum bridge focusing structure 118 is useful for controlling the trajectories of electrons emitted by electron emitters 116.

Vacuum bridge focusing structure 118 is made from a conductive material, preferably a metal, most preferably copper. In general, a vacuum bridge focusing structure in accordance with the invention has a plurality of landings and a plurality of bridges.

Vacuum bridge focusing structure 118 has a plurality of landings 122 and a plurality of bridges 120. Landings 122 are in physical contact with cathode plate 102. In the preferred embodiment of FIG. 1, landings 122 are connected to dielectric layer 110. As illustrated in FIG. 1, each of landings 122 is coextensive with four of bridges 120, two at each end of landing 122.

Each of bridges 120 extends above and beyond landing to which it is connected. In this manner, bridges 120 are spaced apart from cathode plate 102 to define an interspace region 127 therebetween. Preferably interspace region 127 is evacuated. The pressure within FED 100 is less than or equal to about $1.33\times10^{-4}$ Pascal. The separation distance between bridges 120 and cathode plate 102 is selected to provide the desired electric field characteristics within FED 100. One of the benefits of interspace region 127 is that it prevents electrical shorting of gate electrodes 112 by preventing contact between vacuum bridge focusing structure 118 and two or more of gate electrodes 112.

The potential at each of gate electrodes 112 and each of cathodes 109 is independently controllable in order to provide selective addressability of pixels 117. Vacuum bridge focusing structure 118 is also designed to be connected to an independently controllable voltage source (not shown).

In the preferred embodiment of FIG. 1, vacuum bridge focusing structure 118 defines at least two types of openings. One type of opening (openings 123 in FIG. 1) circumscribes a portion of one of gate electrodes 112, which does not include electron emitters 116. Openings 123 are defined by landings 122 and bridges 120. On the other hand, a second type of opening (a plurality of focusing openings 124) circumscribe pixels 117 and are entirely defined by bridges 120.

Openings 123 are useful for reducing capacitance between vacuum bridge focusing structure 118 and gate electrodes 112. Focusing openings 124 provide at least two-dimensional focusing of electrons emitted by electron emitters 116. In the preferred embodiment of FIG. 1, each of focusing openings 124 circumscribes and is centered over one of pixels 117.

The scope of the invention is not limited to focusing openings, which are centered over a pixel. The invention can be embodied by an FED having a vacuum bridge focusing structure having a focusing opening, which is off-center with respect to its corresponding pixel. The invention can further be embodied by an FED having a vacuum bridge focusing structure having a focusing opening, which defines a projected area projected onto the pixel, wherein the projected area is less than the area of the pixel. Such a configuration is useful, for example, for physically blocking electrons that have the largest launch angles with respect to the axis of the electron emitter.

Vacuum bridge focusing structure 118 is self-supporting. That is, no additional structures, such as supporting layers, walls, or spacers, are required to achieve the separation distance from cathode plate 102. For example, no additional structures are required for the purpose of achieving the maximum distance between vacuum bridge focusing structure 118 and cathode plate 102.

The self-supporting characteristic provides many benefits. For example, the self-supporting characteristic allows independent control of the area of focusing openings 124. The area of focusing openings 124 is not restricted to the area of pixels 117. That is, the area of each of focusing openings 124 can be made larger or smaller than the area of the one of pixels 117 to which it corresponds.

FIG. 2 is a cross-sectional view taken along the section lines 2—2 of FIG. 1; FIG. 3 is a cross-sectional view taken along the section lines 3—3 of FIG. 1; and FIG. 4 is a cross-sectional view taken along the section lines 4—4 of FIG. 1. As illustrated in FIGS. 2, 3, and 4, vacuum bridge focusing structure 118 is spaced apart from cathode plate 102 to define interspace region 127 therebetween, which has maximum separation distances, $h_1$ and $h_2$. Separation distances, $h_1$ and $h_2$ can be the same distance or different distances. Further illustrated in FIG. 2 are electrons 119, which are emitted by electron emitters 116 of one of pixels 117.

Cross-talk is a phenomenon that diminishes color purity in an FED. Cross-talk occurs when electrons that are intended for selective activation of one phosphor undesirably activate another phosphor.

In FED 100, cross-talk is reduced by the at least two-dimensional focusing of vacuum bridge focusing structure 118. Cross-talk can be further reduced by physically impeding electrons that have particularly broad launch angles, as indicated in FIG. 2. The area of each of focusing openings 124 can be optimized with regard to cross-talk improvements and efficiency losses due to the physical impediment of some of the electrons.

As illustrated in FIGS. 2 and 3, bridge 118, 120 has maximum separation distances, $h_1$ and $h_2$, from gate electrode 112. The value of $h_1$ and $h_2$ are selected to achieve the desired focusing effect. In the operation of the preferred embodiment, the potential at anode 106 is about 4000 volts; the potential at gate electrodes 112 is about 80 volts; and the potential at vacuum bridge focusing structure 118 is at about ground potential. Furthermore, the distance between cathode plate 102 and anode plate 104 is preferably about one millimeter, and the area of one of pixels 117 is preferably about 0.126 $mm^2$. For this configuration, the value of $h_1$ and $h_2$ are selected to be about 26 micrometers.

The exemplary values of $h_1$ and $h_2$ are appreciably larger than the separation distances between focusing electrodes and gate electrodes commonly encountered in the prior art. Because the value of the capacitance between the gate electrode and the focusing electrode is inversely proportional to the separation distance therebetween, the capacitance between gate electrode 112 and vacuum bridge focusing structure 118 is appreciably less than that of the prior art. The lower capacitance results in the benefit of reduced power losses over that of the prior art.

FIG. 5 is a cross-sectional view similar to that of FIG. 2 of a field emission device 150 having a vacuum bridge focusing structure 158, which defines a plurality of variable-size focusing openings 160, in accordance with a further embodiment of the invention. Variable-size focusing openings 160 are useful, for example, to achieve color balance in a color field emission display.

In the embodiment of FIG. 5, an anode plate 170 has a first phosphor 207, a second phosphor 307, and a third phosphor 407. Each of phosphors 207, 307, and 407 emit light of a color distinct from the others. To achieve color balance, the electron current for third phosphor 407 must be higher than the electron current for second phosphor 307, and the electron current for second phosphor 307 must be higher than the electron current for first phosphor 207.

To achieve the greater electron current, the number of electron emitters 116 of a cathode plate 180 that oppose third phosphor 407 is greater than the number of electron emitters 116 that oppose second phosphor 307. Because openings 160 circumscribe the pixels of FED 150, the size of opening 160, which opposes third phosphor 407, is greater than the size of opening 160, which opposes second phosphor 307. Similarly, the size of opening 160 and the number of electron emitters 116 opposing second phosphor 307 are greater than the size of opening 160 and the number of electron emitters 116, respectively, opposing first phosphor 207.

The scope of the invention is not limited to this particular configuration of relative sizes and relative electron currents. Rather, any configuration suitable for achieving color balance is encompassed in the scope of the invention. Furthermore, it may be desirable to vary the sizes of the focusing openings and the magnitudes of the electron currents for the purpose of adjusting for variation in the efficiencies among the different phosphors.

FIG. 6 is a cross-sectional view similar to that of FIG. 2 of FED 100 having vacuum bridge focusing structure 118, which has a landing 121 between adjacent pixels 117 along one of cathodes 109, in accordance with yet a further embodiment of the invention. In the embodiment of FIG. 6, vacuum bridge focusing structure 118 includes at least two types of landings. The first type includes landings 122, as illustrated in FIGS. 1 and 4, which are located between adjacent gate electrodes 112 and are removed from pixels 117 in the direction of gate electrodes 112. The second type includes landings 121, which are located intermediate adjacent pixels 117 and are attached to dielectric layer 110, as illustrated in FIG. 6.

Figure 7:
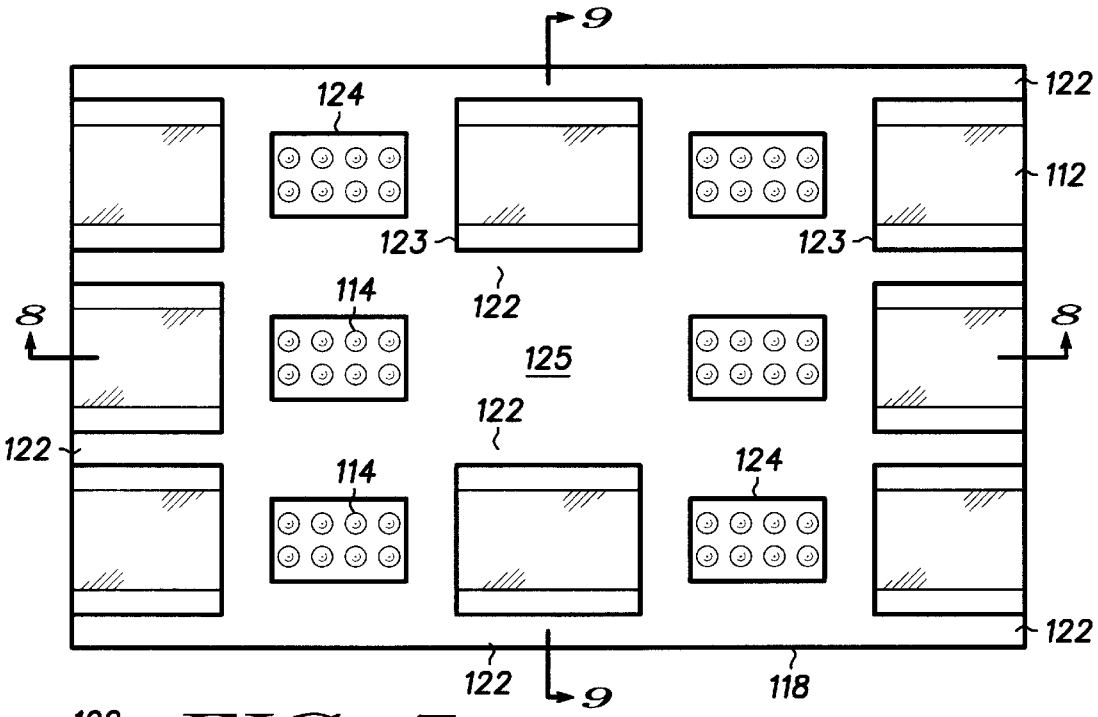
FIG. 7 is a top plan view of a cathode plate of a field emission device in accordance with a preferred embodiment of the invention.

FIG. 7 is a top plan view of cathode plate 102 of FED 100 in accordance with the preferred embodiment of the invention. FIG. 7 further illustrates a getter bridge 125. Getter bridge 125 is located between adjacent openings 123 and is coextensive with a pair of landings 122. In general, a getter bridge in accordance with the invention is a bridge of a vacuum bridge focusing structure that has a gettering material attached to it.

Figure 8:
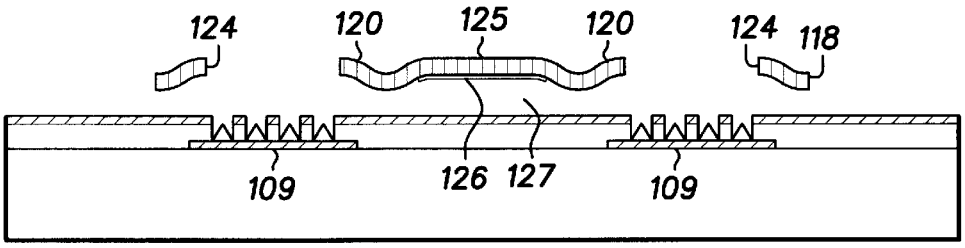
FIG. 8 is across-sectional view taken along the section lines 8—8 of FIG. 7.

FIG. 8 is a cross-sectional view taken along the section lines 8—8 of FIG. 7 and further illustrates getter bridge 125. Getter bridge 125 defines a surface, which opposes cathode plate 102. In accordance with the preferred embodiment, a gettering material 126 coats the surface defined by getter bridge 125.

Gettering material 126 is a material, such as titanium, chrome, and the like, which is useful for removing gaseous contaminants and maintaining the vacuum environment within FED 100. In general, gettering material 126 is a material that can be sublimated for deposition onto the surface of getter bridge 125. Preferably, gettering material 126 is titanium.

Figure 9:
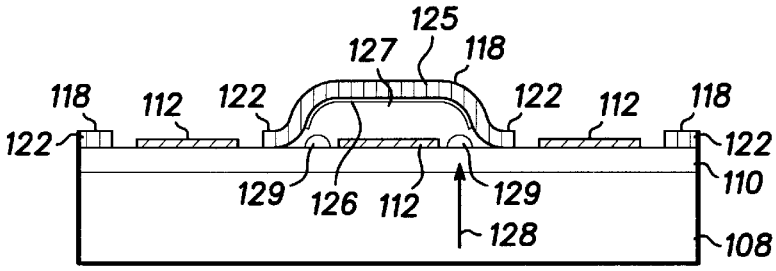
FIG. 9 is a cross-sectional view taken along the section lines 9—9 of FIG. 7.

FIG. 9 is a cross-sectional view taken along the section lines 9—9 of FIG. 7. As illustrated in FIG. 9, gettering material 126 is deposited onto getter bridge 125 by first providing one or more dots 129 of the gettering material on the surface of cathode plate 102. The location of dots 129 is selected to allow access to dots 129 by a laser beam 128, which is indicated by an arrow in FIG. 9. The location of dots 129 is further selected so that the material sublimated by laser beam 128 is deposited onto the surface of getter bridge 125.

Subsequent to the sealing and evacuation of FED 100, laser beam 128 is directed through substrate 108 and dielectric layer 110 to heat dots 129. The gettering material of dots 129 is thus sublimated and deposited onto getter bridge 125.

FIGS. 10–14 are cross-sectional views similar to that of FIG. 6 of cathode plate 102 at various stages in the fabrication of vacuum bridge focusing structure 118. First, cathode plate 102 is fabricated. Methods for making cathode plates having Spindt tip electron emitters are known to one skilled in the art.

After cathode plate 102 has been fabricated, the surface of cathode plate 102 is coated with a layer 130 of photo-resist, as illustrated in FIG. 10. A representative thickness of layer 130 is about 25 micrometers. In general, the thickness of layer 130 determines the separation distance between cathode plate 102 and vacuum bridge focusing structure 118.

Figure 11:
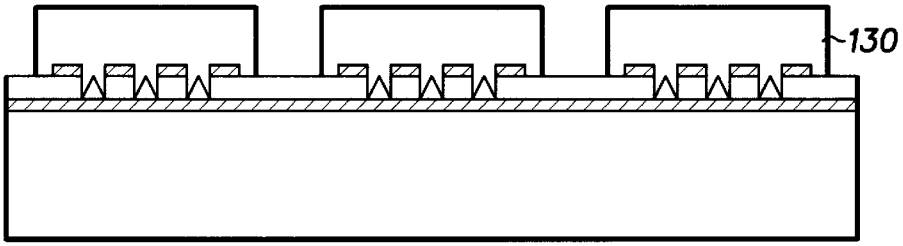

As illustrated in FIG. 11, layer 130 is patterned using photo-exposure and development methods. The pattern of layer 130 defines the locations of the landings and the bridges of the vacuum bridge focusing structure.

Figure 12:
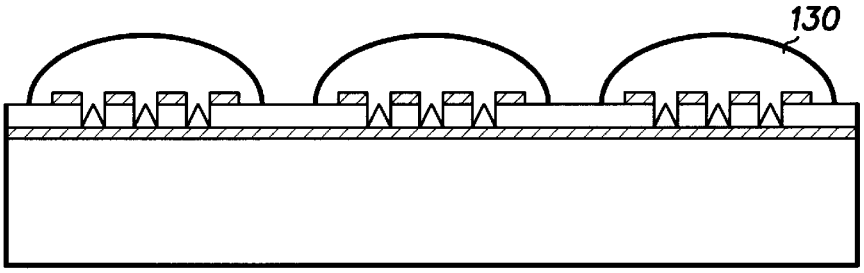

After layer 130 has been patterned, and as illustrated in FIG. 12, layer 130 is heated to cause layer 130 to reflow. The reflow results in the removal of vertical surfaces from layer 130. The rounded, sloping surfaces of layer 130 ensure the continuity of layers that are subsequently deposited onto layer 130. In the preferred embodiment, cathode plate 102 and layer 130 can be baked at 120 degrees Celsius for one to five minutes in air at standard atmospheric pressure.

Figure 13:
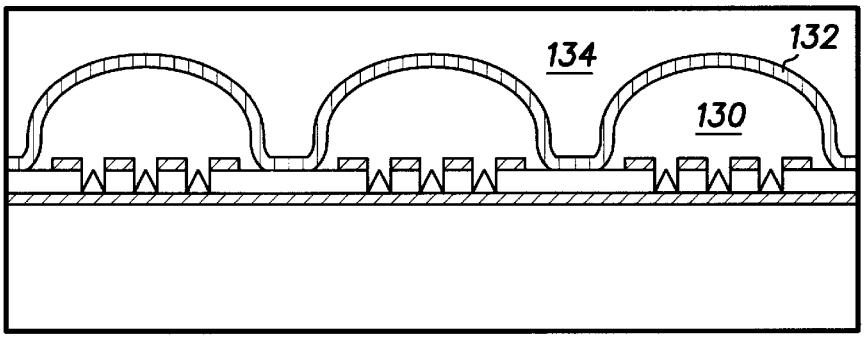

After the heating of layer 130, a seed layer 132 is formed on layer 130, as illustrated in FIG. 13. Seed layer 132 is useful for electroplating the bulk metal of vacuum bridge focusing structure 118. In the preferred embodiment, the bulk metal for vacuum bridge focusing structure 118 is copper. For copper, a useful material for seed layer 132 is chrome and copper. That is, a layer of chrome is deposited by a convenient method onto layer 130, and a layer of copper is deposited onto the layer of chrome. The chrome layer can be about 500 Angstroms, and the copper layer can be about 10,000 Angstroms.

After the formation of seed layer 132, and as further illustrated in FIG. 13, a second resist layer 134 is formed on seed layer 132. Second resist layer 134 can be made from the same photo-resist material of layer 130.

Figure 14:
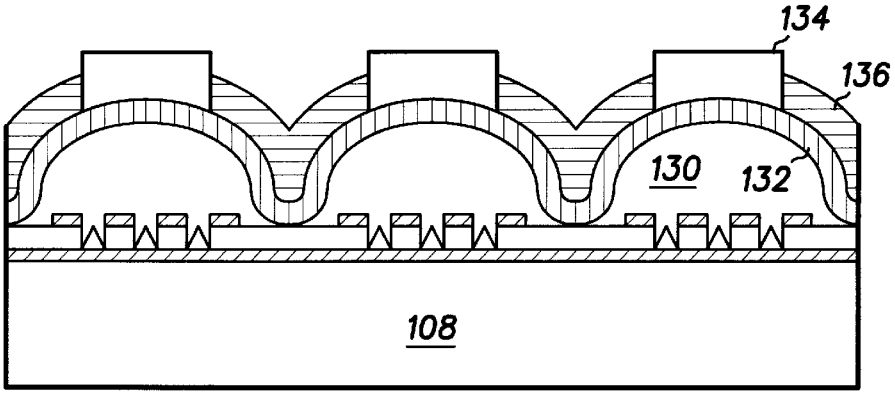

As illustrated in FIG. 14, second resist layer 134 is patterned using photo-exposure and developing methods. The pattern of second resist layer 134 defines the locations of the openings in vacuum bridge focusing structure 118.

After the patterning of second resist layer 134, a conductive layer 136 is deposited by plating, such as electroplating, electroless plating, and the like, onto seed layer 132, as further illustrated in FIG. 14. Conductive layer 136 is preferably made from a metal, such as copper, gold, nickel, and the like. In the preferred embodiment, conductive layer 136 has a thickness of about 10 micrometers.

After the formation of conductive layer 136, second resist layer 134 is removed by photo-exposure and development. Thereafter, seed layer 132 is selectively etched to expose layer 130, and layer 130 is removed with a convenient removal agent.

A field emission device in accordance to the invention is not limited to the embodiments described above. For example, the invention is embodied by a field emission device having a vacuum bridge focusing structure that includes a plurality of spaced apart bridge layers, rather than a unitary structure that extends over the device plate.

Figure 15:
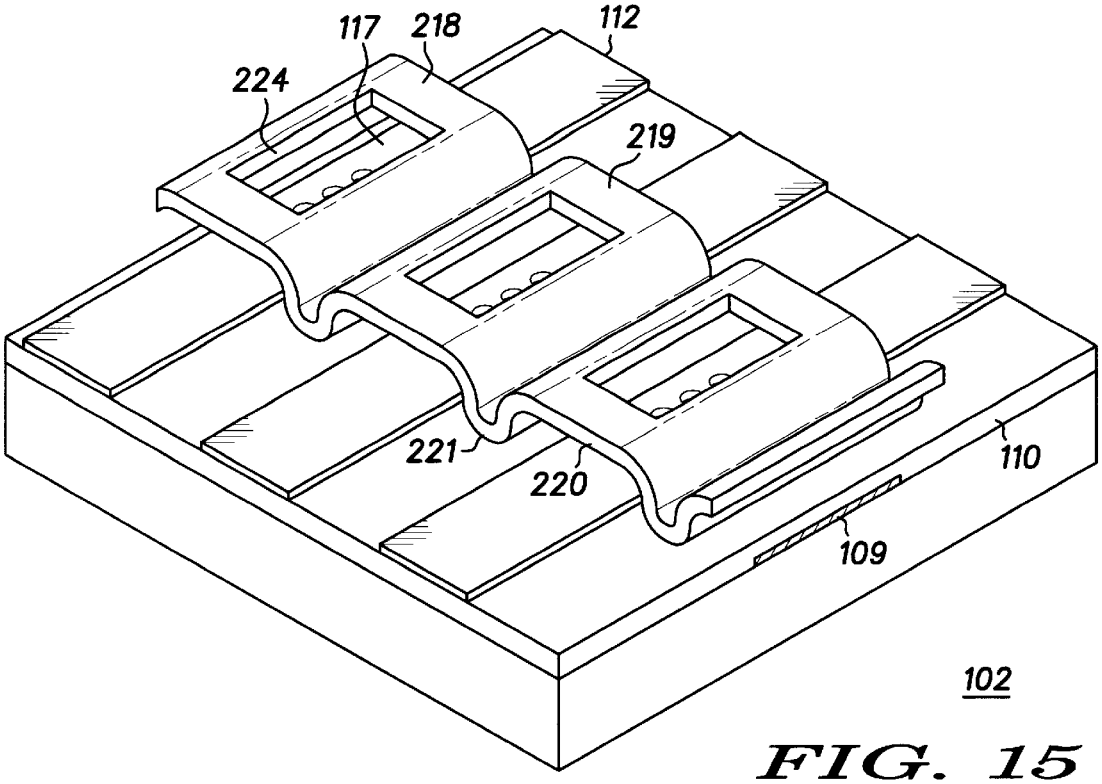
FIG. 15 is a perspective view of a cathode plate of a field emission device having a vacuum bridge focusing structure, which has one bridge layer extending above each cathode, in accordance with another embodiment of the invention.

FIG. 15 is a perspective view of cathode plate 102 of FED 100 having a vacuum bridge focusing structure 218, which has one bridge layer 219 extending above and in the direction of each of cathodes 109, in accordance with another embodiment of the invention. Cathode plate 102 has a plurality of cathodes 109, one of which is shown in FIG. 15. Vacuum bridge focusing structure 218 has a plurality of bridge layers 219, one of which is shown in FIG. 15. In the embodiment of FIG. 15, each of bridge layers 219 overlies and extends in the direction of one of cathodes 109.

Each of bridge layers 219 has a plurality of bridges 220 and a plurality of landings 221. Each of bridges 220 defines an opening 224, which overlies one of pixels 117. Bridges 220 also provide electrical isolation between vacuum bridge focusing structure 218 and gate electrodes 112. Bridges 220 further prevent electrical shorting of gate electrodes 112. Each of landings 221 is located intermediate two adjacent pixels 117.

Bridge layers 219 of the embodiment of FIG. 15 provide numerous advantages. For example, the potential at each of bridge layers 219 can be independently controlled. Preferably, bridge layers 219 are not connected, and each of bridge layers 219 is connected to an independently controllable voltage source (not shown). Alternatively, bridge layers 219 can be connected at some location, such as outside the emissive area of cathode plate 102, to a common voltage source (not shown).

Figure 16:
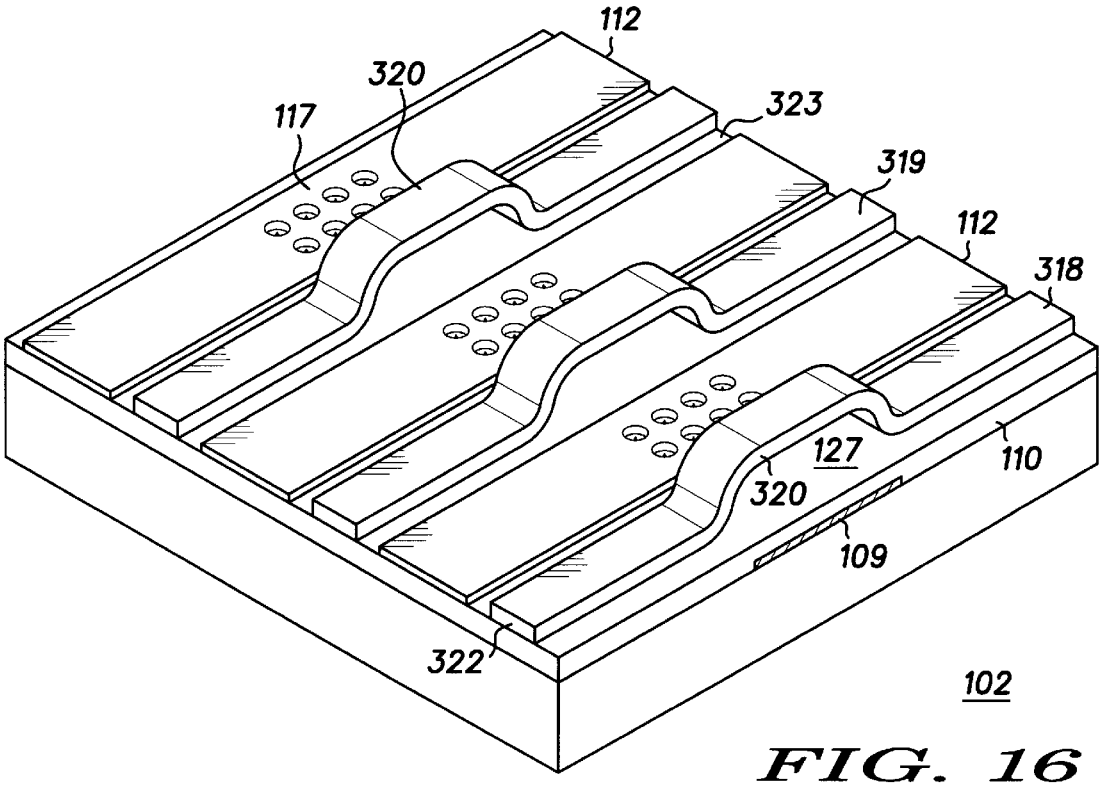
FIG. 16 is a perspective view of a cathode plate of a field emission device having a vacuum bridge focusing structure, which has one bridge layer located between each pair of adjacent gate electrodes, in accordance with yet another embodiment of the invention.

FIG. 16 is a perspective view of cathode plate 102 of FED 100 having a vacuum bridge focusing structure 318, which has one bridge layer 319 located between each pair of adjacent gate electrodes 112, in accordance with yet another embodiment of the invention. As illustrated in FIG. 16, gate electrodes 112 define a plurality of inter-gate surfaces 323. One of bridge layers 319 is attached to dielectric layer 110 at one of inter-gate surfaces 323. Bridge layers 319 extend in the direction of gate electrodes 112 and across cathode plate 102.

Each of bridge layers 319 has a plurality of bridges 320 and a plurality of landings 322. In the embodiment of FIG. 16, bridges 320 do not define openings. Rather, any two of bridges 320, which oppose one another across one of pixels 117, define a gap thereover. This configuration allows at least one-dimensional focusing primarily in the direction of cathodes 109. The height of bridges 320 is selected to cause the desired focusing effect. Landings 322 are connected to dielectric layer 110 outside of pixels 117.

Bridge layers 319 of the embodiment of FIG. 16 provide numerous advantages. For example, the potential at each of bridge layers 319 can be independently controlled. The independent control of the potential at each of bridge layers 319 can be used to provide independent control of the extent of focusing from each side of pixels 117. This capability can be used, for example, to correct for slight misalignments of cathode plate 102 and anode plate 104, which may occur during the sealing of the package.

The independent control of the potential at each of bridge layers 319 can also be used to reduce power losses due to capacitance between vacuum bridge focusing structure 318 and cathode plate 102. During the operation of FED 100, gate electrodes 112 are sequentially addressed. While one of gate electrodes 112 is being addressed, potentials are applied to cathodes 109 according to video data.

The one of gate electrodes 112 being addressed is located intermediate a pair of bridge layers 319. The potentials applied to this pair of bridge layers 319 are selected to achieve a focusing effect. To reduce power requirements, the potentials at the remaining bridge layers 319 are selected to minimize the voltage differences between the remaining bridge layers 319 and the electrodes of cathode plate 102, such as cathodes 109.

Because power loss due to capacitance is proportional to the square of the voltage difference, minimizing the voltage differences between the remaining bridge layers 319 and the electrodes of cathode plate 102 also minimizes the resulting power loss due to these voltage differences. The optimal potentials for the remaining bridge layers 319 are determined each time one of gate electrodes 112 is addressed and are determined based upon the given set of potentials applied to cathodes 109.

Preferably, bridge layers 319 are not connected, and each of bridge layers 319 is connected to an independently controllable voltage source (not shown). Alternatively, bridge layers 319 can be connected at some location, such as outside the emissive area of cathode plate 102, to a common voltage source (not shown).

Vacuum bridge focusing structure 318 is self-supporting. Bridges 320 thus do not require underlying support layers to maintain their separation distance from dielectric layer 110. Rather, interspace region 127 between bridges 320 and cathode plate 102 has a vacuum. Because a vacuum is characterized by a lower permittivity constant than that of a solid (such as a dielectric or an organic solid), the capacitance between bridges 320 and cathodes 109 is lower than a similar structure that utilizes solid support layers and is not self-supporting.

Vacuum bridge focusing structure 318 can be made using the approach described with reference to FIGS. 10–14. Alternatively, bridge layers 319 can be formed using wire bonding methods.

The scope of the invention is also not limited to attachment of a vacuum bridge focusing structure to the cathode plate. The invention is also embodied by a field emission device having a vacuum bridge focusing structure attached to the anode plate. A vacuum bridge focusing structure for attachment to an anode plate can include any one of the vacuum bridge focusing structures described with reference to FIGS. 1–16.

FIG. 17 is a cross-sectional view of an FED 400 having a vacuum bridge focusing structure 418 attached to anode plate 104, in accordance with still yet another embodiment of the invention. In the embodiment of FIG. 17, vacuum bridge focusing structure 418 has a structure similar to that of vacuum bridge focusing structure 118 as described with reference to FIG. 6.

In the embodiment of FIG. 17, a protective layer 419 is formed on phosphors 107. Protective layer 419 protects phosphors 107 during the fabrication of vacuum bridge focusing structure 418. Preferably, protective layer 419 is made from aluminum, which also serves to reflect light emitted by phosphors 107.

FED 400 further includes a dielectric layer 423, which is formed on protective layer 419. Dielectric layer 423 is located in spaces between phosphors 107. Vacuum bridge focusing structure 418 has a plurality of landings 421 and a plurality of bridges 420. Landings 421 are attached to dielectric layer 423. Bridges 420 define a plurality of openings 424. Each of openings 424 overlies one of phosphors 107. Because vacuum bridge focusing structure 418 is self-supporting, no support layer is required to provide the separation distance between each of openings 424 and anode plate 104.

Furthermore, the self-supporting characteristic of vacuum bridge focusing structure 418 allows the area of each of focusing focus openings 424 to be made smaller than the area of its corresponding pixel. For the purpose of illustration, the shape of each of phosphors 107 and openings 424 is assumed to be circular. As further indicated in FIG. 17, the diameter, d, of each of openings 424 is smaller than the diameter, D, of each of phosphors 107. Thus, the area of each of openings 424 is less than the area of each of phosphors 107.

A focusing opening that is smaller than the phosphor can be useful for physically blocking contaminants 428, which originate from anode plate 104 and which are indicated by arrows in FIG. 17. Contamination of device elements, such as electron emitters 116, is thus ameliorated.

In the operation of FED 400, a potential is applied to anode 106 using a first voltage source 425. Simultaneously, a potential, which is lower than that at anode 106, is applied to vacuum bridge focusing structure 418 using an independently controllable voltage source 426. Electrons 427 are caused to be emitted from electron emitters 116 and are attracted toward the high potential at phosphors 107. When electrons 427 activate phosphors 107, contaminants 428 may be generated.

Figure 18:
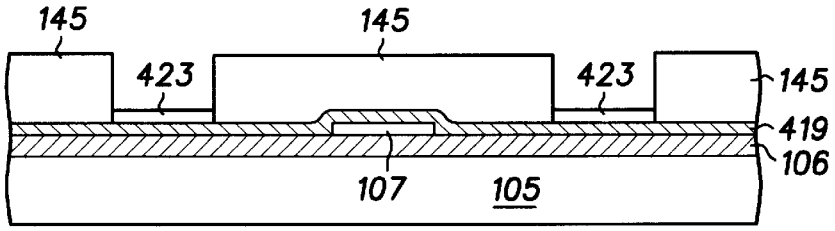
FIGS. 18–23 are cross-sectional views of an anode plate at various stages in the fabrication of a vacuum bridge focusing structure in accordance with another embodiment of the invention.

A method for fabricating vacuum bridge focusing structure 418, in accordance with the invention, is illustrated in FIGS. 18–23. FIG. 18 illustrates, in cross-section, a portion of anode plate 104 at an intermediate step in the fabrication process.

As shown in FIG. 18, subsequent to the deposition of protective layer 419, a dielectric layer 423 is patterned onto protective layer 419. Subsequent to the formation of dielectric layer 423, and as further illustrated in FIG. 18, a first resist layer 145 is applied to anode plate 104. First resist layer 145 is patterned using photo-exposure and developmental methods. The pattern of first resist layer 145 is useful for defining the locations for attachment of landings 421. Either a positive resist or a negative resist is used to obtain good definition. The thickness of first resist layer 145 is useful for determining the height of vacuum bridge focusing structure 418.

Figure 19:
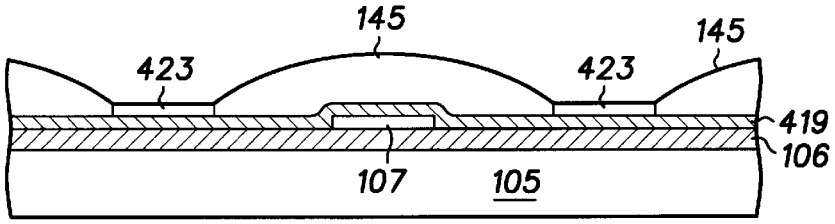

After first resist layer 145 has been patterned, and as shown in FIG. 19, first resist layer 145 is heated to cause first resist layer 145 to reflow. The heating results in the removal of vertical surfaces from first resist layer 145. The rounded, sloping surfaces of first resist layer 145 ensure the continuity of layers that are subsequently deposited onto first resist layer 145. For example, anode plate 104 and first resist layer 145 can be baked at 120 degrees Celsius for one to five minutes in air at standard atmospheric pressure.

Figure 20:
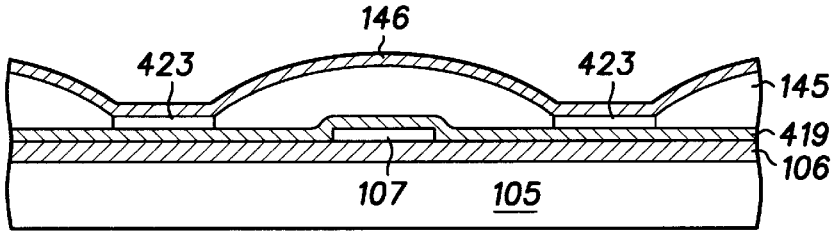

Subsequent to the step of heating of first resist layer 145, a conductive layer 146 is formed on first resist layer 145, as illustrated in FIG. 20. Conductive layer 146 is preferably a conductive sol-gel. The conductive sol-gel is preferably made by combining one of a metal alkoxide compound, an organometallic compound, and a cross-linking compound with a solvent, such as methyl alcohol, ethyl alcohol, water, and the like. For example, a cross-linking compound, such as sodium vanadate can be combined with water in the ratio of 1 gram sodium vanadate to 10 grams water to form a conductive sol-gel. The sol-gel is then deposited by a convenient deposition technique, such as spinning, spraying, dip coating, vapor deposition and the like. An exemplary thickness of conductive layer 146 is approximately 1 micrometer. h However other thicknesses may be used.

Figure 21:
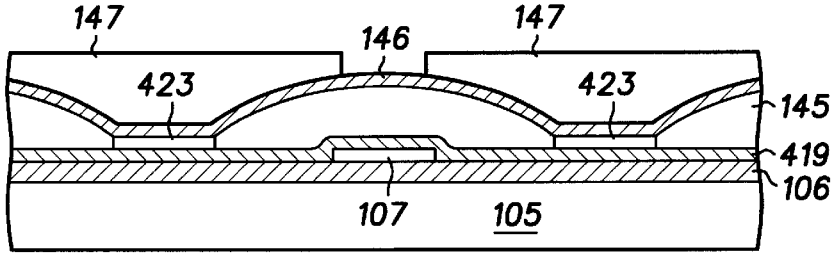

After the formation of conductive layer 146, a second resist layer 147 is applied to conductive layer 146, as illustrated in FIG. 21. Second resist layer 147 is patterned using photo-exposure and developmental methods. The pattern of second resist layer 147 is useful for defining the locations of openings 424 in vacuum bridge focusing structure 418.

Figure 22:
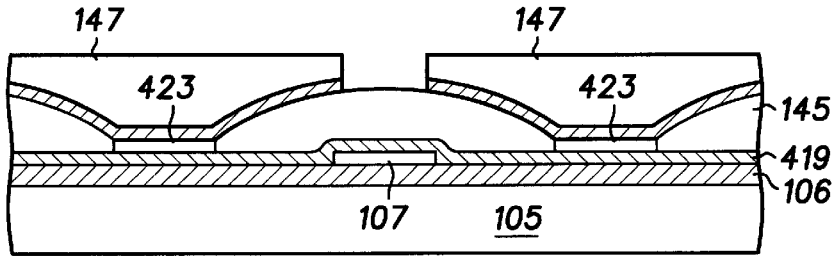

Subsequent to the formation of second resist layer 147, conductive layer 146 is selectively etched, as illustrated in FIG. 22. The selective etching results in the removal of the exposed portions of conductive layer 146. The selective etching of conductive layer 146 is preferably achieved using a wet etchant, such as hydrofluoric acid. The hydrofluoric acid is unable to attack anode plate 104 because first resist layer 145 is fully intact. Other etchants may also be used without affecting the surface of the anode plate 104.

Figure 23:
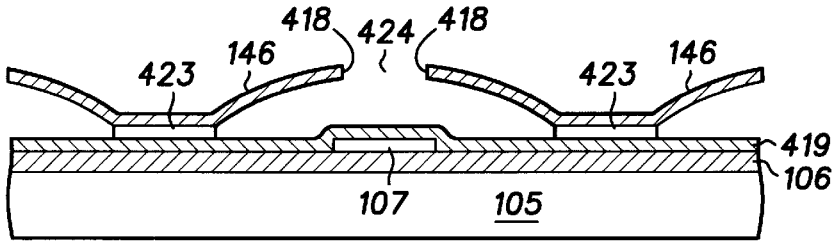

Subsequent to the step of selectively etching conductive layer 146, first resist layer 145 and second resist layer 147 is removed as illustrated in FIG. 23. First resist layer 145 and second resist layer 147 are removed by using a convenient solvent such as acetone. In this manner, vacuum bridge focusing structure 418 is formed on anode plate 104.

FIG. 24 is a cross-sectional view of FED 100 having a spacer 500 supported on landing 122 of vacuum bridge focusing structure 118, in accordance with the preferred embodiment of the invention. Spacer 500 is useful for maintaining the separation distance between cathode plate 102 and anode plate 104. Spacer 500 is made from a convenient material, such as a dielectric, a high-capacitance material, and the like. The material of spacer 500 is selected to maintain the potential difference between cathode plate 102 and anode plate 104, while preventing excessive current flow therebetween through spacer 500.

Spacer 500 is preferably attached to landing 122. Attachment can be achieved by providing at the edge of spacer 500 a material (not shown) that can be bonded to the surface material of landing 122.

For example, spacer 500 can include a rib made from a dielectric material. An edge of the rib is coated with gold, and the surface of landing 122 is coated with gold. The gold of the edge of spacer 500 is bonded to the gold of the surface of landing 122 by a convenient bonding method, such as thermocompression bonding.

Landing 122 is useful for controlling the potential at spacer 500. Landing 122 also provides a compliant layer that is useful for ensuring separation of spacer 500 from underlying electrodes, such as portions of cathodes 109 that extend beneath spacer 500.

Figure 25:
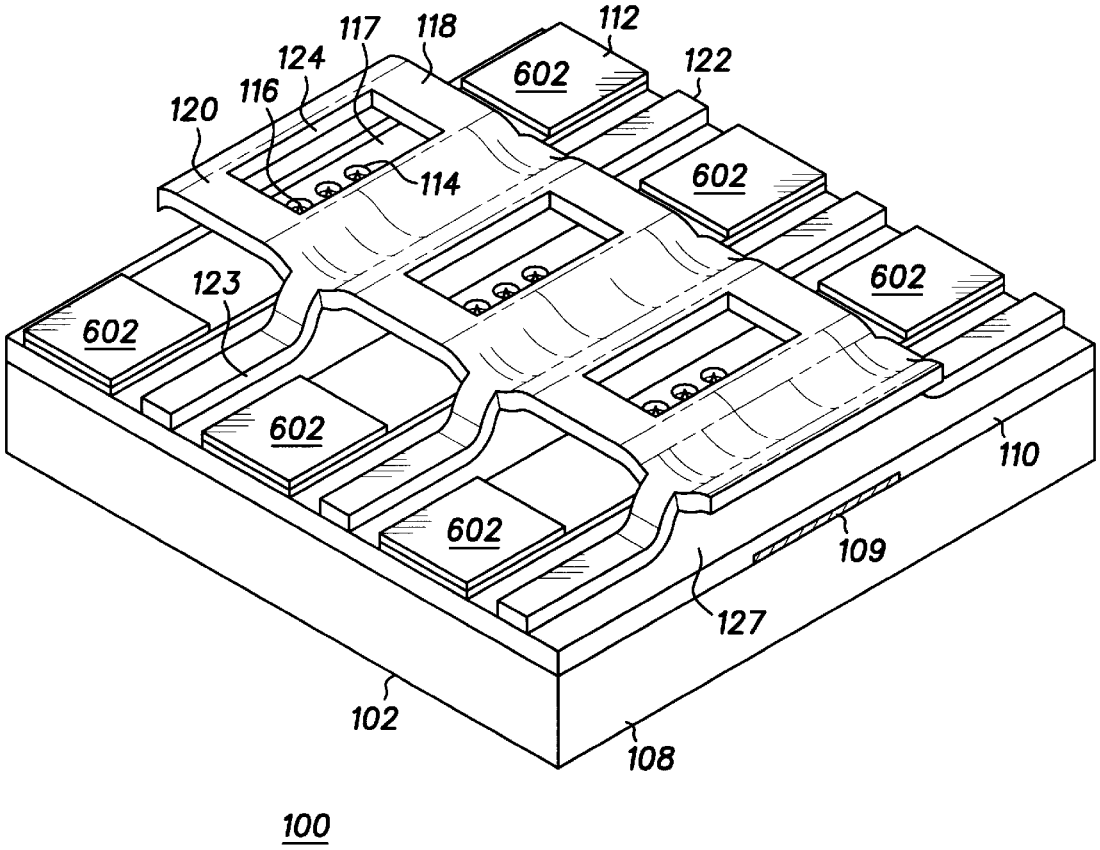
FIG. 25 is a perspective view of a cathode plate of a field emission device having a vacuum bridge focusing structure, and additional conductive plating applied to the gate electrodes in accordance with yet another embodiment of the invention.

FIG. 25 is a perspective view of FED 100 with conductive layer 602 formed on gate electrodes 112 in accordance with a further embodiment of the invention. Conductive layer 602 applied to gate electrode 112 has the effect of providing additional conductive area to portions of gate electrode 112. The additional conductive area is useful for lowering the resistance of gate electrode 112. In general, the lower resistance provides for a lower voltage drop in gate electrode 112 and a corresponding reduction in power requirement for the field emission display. Conductive layer 602 is formed in conjunction with vacuum bridge focusing structure 118, utilizing one of the seed layer with electroplating of bulk metal and conductive sol-gel techniques described above.

In summary, the invention is for a field emission device having a vacuum bridge focusing structure and a method of fabricating the field emission device. The vacuum bridge focusing structure of the invention provides numerous advantages, such as reduction in contaminant gases and reduced power requirements.

While we have shown and described specific embodiments of the present invention, further modifications and improvements will occur to those skilled in the art. For example, the anode and the protective layer on the anode plate can be patterned, such that the landings of a vacuum bridge focusing structure can be attached to the transparent substrate of the anode plate. As a further example, a vacuum bridge focusing structure can be attached to each of the cathode plate and the anode plate of a given field emission device. As yet a further example, a method for fabricating a field emission device can include forming a vacuum bridge focusing structure on the anode plate of a given field emission device using a metal. As yet another example, a method for fabricating a field emission device can include forming a vacuum bridge focusing structure on the cathode plate of a given field emission device using sol-gel. Furthermore, the invention can be embodied in devices other than cathodoluminescent displays, such as infrared displays, digital-to-analog signal converters, and the like. We desire it to be understood, therefore, that this invention is not limited to the particular forms shown and we intend in the appended claims to cover all modifications that do not depart from the spirit and scope of this invention.

What is claimed is:

1. A field emission device comprising:

a cathode plate having a plurality of electron emitters;

an anode plate disposed to receive electrons emitted by the plurality of electron emitters; and a vacuum bridge focusing structure disposed on one of the cathode plate and the anode plate, wherein the vacuum bridge focusing structure is unitary and self-supporting, wherein the vacuum bridge focusing structure is comprised of a landing and a bridge, wherein the landing is disposed on the one of the cathode plate and the anode plate, and wherein the bridge is coextensive and unitary with the landing and is spaced apart from one of the cathode plate and the anode plate to define an interspace region therebetween;

whereby the vacuum bridge focusing structure controls trajectories of the electrons emitted by the plurality of electron emitters.

2. The field emission device as claimed in claim 1, wherein the vacuum bridge focusing structure is designed to be connected to an independently controllable voltage source.

3. The field emission device as claimed in claim 1, wherein the vacuum bridge focusing structure comprises a conductive material.

4. The field emission device as claimed in claim 3, wherein the conductive material comprises a metal.

5. The field emission device as claimed in claim 4, wherein the metal comprises copper.

6. The field emission device as claimed in claim 1, wherein the cathode plate has a gate electrode, and wherein the vacuum bridge focusing structure defines an opening overlying a portion of the gate electrode.

7. The field emission device as claimed in claim 1, wherein the vacuum bridge focusing structure defines a first opening overlying the plurality of electron emitters.

8. The field emission device as claimed in claim 7, wherein the first opening is centered over the plurality of electron emitters.

9. The field emission device as claimed in claim 7, wherein the cathode plate further has a second plurality of electron emitters, wherein the vacuum bridge focusing structure further defines a second opening overlying the second plurality of electron emitters, and wherein the first opening is smaller than the second opening.

10. The field emission device as claimed in claim 1, wherein the anode plate comprises a phosphor, and wherein the plurality of electron emitters are disposed to selectively address the phosphor.

11. The field emission device as claimed in claim 1, wherein the anode plate has a phosphor, and wherein the vacuum bridge focusing structure defines an opening overlying the phosphor.

12. The field emission device as claimed in claim 1, further comprising a spacer extending between the anode plate and the landing of the vacuum bridge focusing structure.

13. The field emission device as claimed in claim 12, wherein the spacer is attached to the landing of the vacuum bridge focusing structure.

14. The field emission device as claimed in claim 1, wherein the bridge defines a surface opposing the one of the cathode plate and the anode plate, and further comprising a gettering material disposed on the surface defined by the bridge.

15. The field emission device as claimed in claim 14, wherein the gettering material comprises titanium.

16. The field emission device as claimed in claim 1, wherein the landing comprises a conductive material.

17. The field emission device as claimed in claim 1, wherein the interspace region is evacuated.

18. The field emission device as claimed in claim 1, wherein the one of the cathode plate and the anode plate define a dielectric surface, and wherein the landing is disposed on the dielectric surface.

19. The field emission device as claimed in claim 1, wherein the cathode plate further comprises a plurality of cathodes, wherein the vacuum bridge focusing structure comprises a plurality of bridge layers, and wherein each of the plurality of bridge layers overlies and extends in the direction of one of the plurality of cathodes.

20. The field emission device as claimed in claim 19, wherein each of the plurality of bridge layers is adapted to be connected to an independently controllable voltage source.

21. The field emission device as claimed in claim 1, wherein the cathode plate further has a plurality of gate electrodes, wherein the plurality of gate electrodes define a plurality of inter-gate surfaces, wherein the vacuum bridge focusing structure comprises a plurality of bridge layers disposed one each on the plurality of inter-gate surfaces, and wherein the plurality of bridge layers extends in the direction of the plurality of gate electrodes.

22. The field emission device as claimed in claim 21, wherein each of the plurality of bridge layers is adapted to be connected to an independently controllable voltage source.

23. The field emission device as claimed in claim 1, wherein said cathode plate further comprises:

a dielectric surface; and at least one electrode disposed on said dielectric surface.

24. The field emission device as claimed in claim 23, wherein said electrode of said cathode plate comprises a gate electrode.

25. The field emission device as claimed in claim 24, wherein a conductive layer is disposed on at least a portion of said gate electrode.

26. The field emission device as claimed in claim 25, wherein said conductive layer comprises a metal.

27. The field emission device as claimed in claim 26, wherein said conductive layer is comprised of copper.

28. The field emission device as claimed in claim 25, wherein said conductive layer comprises a conductive sol-gel.

29. A field emission device comprising:

a cathode plate having a plurality of electron emitters;

an anode plate disposed to receive electrons emitted by the plurality of electron emitters; and a unitary vacuum bridge focusing structure having a landing and a bridge, wherein the unitary vacuum bridge focusing structure is self-supporting, wherein the landing is disposed on one of the cathode plate and the anode plate, wherein the bridge is coextensive and unitary with the landing, and wherein the bridge is spaced apart from the one of the cathode plate and the anode plate to define an interspace region therebetween, whereby the vacuum bridge focusing structure is useful for controlling trajectories of electrons emitted by the plurality of electron emitters.

30. The field emission device as claimed in claim 29, wherein the landing comprises a conductive material.

31. The field emission device as claimed in claim 29, wherein the landing is disposed on the cathode plate, wherein the cathode plate has a gate electrode, and wherein the bridge is spaced apart from the gate electrode to define the interspace region therebetween.

32. The field emission device as claimed in claim 31, wherein the interspace region is evacuated.

33. The field emission device as claimed in claim 29, wherein the cathode plate further has a dielectric layer and first and second gate electrodes disposed on the dielectric layer, and wherein the landing is disposed on the dielectric layer intermediate the first and second gate electrodes.

34. The field emission device as claimed in claim 29, wherein the one of the cathode plate and the anode plate define a pixel having an area, wherein the bridge defines an opening overlying the pixel, wherein the opening defines a projected area projected onto the pixel, and wherein the projected area is less than the area of the pixel.

35. A field emission device comprising:

a cathode plate having a plurality of electron emitters;

an anode plate having a phosphor disposed to receive electrons emitted by the plurality of electron emitters; and a unitary vacuum bridge focusing structure having a landing and a bridge, wherein the unitary vacuum bridge focusing structure is self-supporting, wherein the landing is disposed on one of the cathode plate and the anode plate, wherein the bridge is coextensive and unitary with the landing, and wherein the bridge is spaced apart from the one of the cathode plate and the anode plate to define an interspace region therebetween, whereby the vacuum bridge focusing structure is useful for controlling trajectories of the electrons emitted by the plurality of electron emitter.

36. The field emission device as claimed in claim 35, wherein the bridge defines an opening, and wherein the opening is disposed to cause the electrons to be received by the phosphor.

37. A method for fabricating a field emission device comprising the steps of:

providing a cathode plate having a plurality of electron emitters;

providing an anode plate having a plurality of phosphors; and forming a vacuum bridge focusing structure on one of said cathode plate and said anode plate, wherein the vacuum bridge focusing structure is unitary and self-supporting, wherein the vacuum bridge focusing structure is comprised of a landing and a bridge, wherein the landing is disposed on the one of the cathode plate and the anode plate, and wherein the bridge is coextensive and unitary with the landing and is spaced apart from one of the cathode plate and the anode plate to define an interspace region therebetween.

38. The method of claim 37, wherein the step of forming a vacuum bridge focusing structure comprises the step of forming a bridge.

39. The method of claim 38, wherein the step of forming a vacuum bridge focusing structure comprises the step of forming a conductive layer.

40. The method of claim 39, wherein said conductive layer comprises a metal.

41. The method of claim 40, wherein said conductive layer comprises copper.

42. The method of claim 39, wherein said conductive layer comprises a conductive sol-gel.

43. The method of claim 38, wherein the step of forming a vacuum bridge focusing structure comprises the step of forming a bridge defining a hole in registration with said plurality of electron emitters.

44. The method of claim 38, wherein the step of forming a vacuum bridge focusing structure comprises the step of forming a bridge defining a hole in registration with one of said plurality of phosphors.

* * * * *